US005635964A

United States Patent [19]

Burr et al.

[11] Patent Number: 5,635,964

[45] Date of Patent: Jun. 3, 1997

[54] INK-JET PRINT HEAD HAVING IMPROVED THERMAL UNIFORMITY

[75] Inventors: Ronald F. Burr, Wilsonville; James D. Padgett, Portland; James D. Buehler, Troutdale; Meade Neal, Mulino, all of Oreg.

[73] Assignee: Tektronix, Inc., Wilsonville, Oreg.

[21] Appl. No.: 374,938

[22] Filed: Jan. 18, 1995

[51] Int. Cl.[6] ..... B41J 29/38

[52] U.S. Cl. ..... 347/17; 347/18; 347/88

[58] Field of Search ..... 347/17, 18, 66, 347/67, 88, 85

[56] References Cited

U.S. PATENT DOCUMENTS

| | | | |
|---|---|---|---|
| 4,395,146 | 7/1983 | Arai . | |
| 5,175,565 | 12/1992 | Ishinaga et al. | 347/67 |
| 5,270,730 | 12/1993 | Yaegashi et al. | 347/88 |
| 5,285,049 | 2/1994 | Fukumoto et al. | 219/216 |
| 5,424,767 | 6/1995 | Alavizadeh et al. | 347/88 |

FOREIGN PATENT DOCUMENTS 0353925 2/1990 European Pat. Off. .

*Primary Examiner*—Valerie Lund

*Attorney, Agent, or Firm*—Ralph D'Alessandro; Michael O. Scheinberg

[57] ABSTRACT

An improved media-width phase-change ink-jet print had (102) maintains a uniform temperature across its width to produce consistent drop mass and uniform print quality. The print head uses a heater (120) including two separately controlled, overlapping heating zones (154). The heating zones produce heat gradients (170, 172) that have maximum outputs toward opposing edges (**168*a*, 168*b*) of the print head and are controlled in response to thermistors (138*s*, 168*b*) positioned at the corresponding edges. The two heating zones together produce a linear heat gradient (180) across the print heat to compensate for uneven head-to-drum spacing (166) and other unsymmetrical thermal loads on the print head. The improved print head also includes baffles (192) that reduce air flow between the head and the attached reservoir (118), and thermal breaks (218) that insulate the section (220**) of the head that includes the jets from the thermal gradients at the edges of the print head.

20 Claims, 6 Drawing Sheets

INK-JET PRINT HEAD HAVING IMPROVED THERMAL UNIFORMITY

TECHNICAL FIELD

This invention relates to phase-change ink-jet printing and more particularly to an improved heater for heating the ink in a multiple-orifice ink-jet head to a uniform temperature throughout the print head.

BACKGROUND OF THE INVENTION

Previously known apparatus and methods provide phase-change ink to a multiple-orifice ink-jet print head, apply heat to melt the ink in a controlled manner, and selectively jet the melted ink toward an image-receiving medium, such as paper or some intermediate transfer medium, such as an image transfer drum to form a printed image. Phase-change ink is particularly advantageous because of its convenience, image quality, economy, and use of conventional print media.

In particular, U.S. Pat. No. 4,418,355 for an INK JET APPARATUS WITH PRELOADED DIAPHRAGM AND METHOD OF MAKING SAME describes a multiple-orifice ink-jet print head having an elongated serpentine-shaped heater element pressed against a heat-spreading ink reservoir wall plate for melting phase-change ink contained in the reservoir. A thermistor is inserted into a centrally located well in the ink reservoir wall plate to sense the ink reservoir temperature. The ink-jet print head reciprocates back and forth across a print medium while selectively jetting ink from piezoelectric transducer-driven jets to print an image.

Skilled workers know that an ink-jet print head ejects ink drops at a velocity that is determined by various parameters including the energy imparted to the ink by the piezoelectric transducer, the geometry of features in the head, and the ink viscosity. In particular, the viscosity of phase-change ink varies widely with temperature, a typical ink being solid at room temperature, rubbery near its 86 degree Celsius melting point, and a flowing liquid at its jetting temperature of about 130 degrees to about 140 degrees Celsius. Given a typical ink-jet head and a fixed amount of transducer energy, ink drop ejection velocity changes about two to about three percent per degree Celsius.

Because the ink-jet print head moves relative to the image-receiving medium while ejecting drops of ink, the landing points of the drops will vary in proportion to changes in drop ejection velocity. Therefore, to ensure acceptable drop landing accuracy, the phase-change ink temperature should be regulated and should be substantially the same for each jet of the multiple-orifice ink-jet print head. Ink temperature variations of greater than about three degrees Celsius can cause visible ink drop landing errors.

The voltage applied to the piezoelectric transducer of each jet can be "normalized," i.e., adjusted within a narrow range, to compensate for nonuniformities in jet construction and temperature, but such adjustment is often inadequate to compensate for the temperature nonuniformities within the print head. Furthermore, normalization is a factory adjustment that cannot dynamically adjust for changes in the thermal load on the ink-jet print head caused by environmental factors.

Factors causing temperature nonuniformity from jet to jet include nonuniform heat conduction losses, convection losses into the air, and radiation losses from the print head into adjacent objects. Convection losses are especially nonuniform in printers using a print head that reciprocates back and forth, thereby "fanning" the leading and trailing edges of the print head more than its central portions. Variations in the spacing between the ink-jet print head and the image-receiving medium cause temperature variations in the ink-jet print head because heat is more readily lost at closer spacings. Such spacing variations can occur, for example, if the ink-jet print head is mounted at a slight angle to the image-receiving medium. Other factors that dynamically change the thermal load on the print head include internal fans turning on and off, the actual printing process, access doors being opened and closed, and variations in the head to drum spacing.

Maintaining substantially the same ink temperature for each ink jet becomes more difficult as print heads become wider to accommodate additional ink-jet orifices. U.S. Pat. No. 5,087,930 for a DROP-ON-DEMAND INK JET PRINT HEAD, which is assigned to the assignee of this application, describes a 95-millimeter-wide, 96-orifice print head designed for ejecting phase-change inks. The ink-jet print head is attached to an ink reservoir that is mounted on a reciprocating carriage as described in U.S. Pat. No. 5,083,143 for ROTATIONAL ADJUSTMENT OF AN INK JET HEAD, which is assigned to the assignee of this application.

Referring to FIG. 1, a prior art ink-jet print head heater 10 was developed that generates more heat at the edges near its shorter side margins than at its central portion, in order to compensate for nonuniform convection losses near the shorter side margins of the 96-orifice print head. Heater 10 is a conventional flex circuit in which a heater foil 12 is formed from etched Inconel® (alloy 600) foil material laminated between a pair of Kapton® insulating layers. A heat-spreading copper foil layer is bonded to one of the Kapton® layers. Heater 10 is sized to match a major surface of the 96-orifice print head.

Heater foil 12 is electrically connected by a pair of contacts 14 to a temperature controller 16, which uses a single temperature sensor attached to the ink-jet print head. Temperature controller 16 applies a pulse-duration modulated voltage across contacts 14 in response to the temperature sensed by a thermistor 18. Heater foil 12 has a set of eleven adjacent heating areas 20 (shown generally as regions bounded by dashed lines) spaced across the X-dimension (width) of heater 10. Because electrical current flow is equal everywhere along heater foil 12, the watt-density in any area 20 is proportional to the electrical resistance of heater foil 12 in that area. The resistance of heater foil 12 is, therefore, made larger in heater areas 20 near contacts 14 than in heater areas 20 near thermistor 18. The watt-densities of heater areas 20 vary from about 2 to 2.5 watts per square centimeter near the center of heater 10 to about 3 to 3.25 watts per square centimeter at its left and right edges.

Thermistor 18 is embedded in a well in the 96-orifice print head. Access to thermistor 18 is gained through a cutout region 22 in heater 10. The location of thermistor 18 is not critical outside of the intended control area because the temperature sensed anywhere along the width of the 96-orifice print head is equalized elsewhere along the width of the print head by the zoned watt-density of heater 10. Because the phase-change ink is in intimate contact with the print head, equalizing the print head temperature also equalizes the ink temperature.

Another complication in print head design is that certain phase-change inks decompose if kept at an elevated temperature for extended periods of time. This decomposition places additional restriction on the thermal environment around the ink-jet print head, as well as additional demands on the ink-jet print head heater. For example, the reservoir and print head are in close proximity to allow ink to flow between them, but they are thermally isolated and have separate heaters and temperature sensors. Predetermined amounts of phase-change ink are melted and stored in the reservoir at a temperature slightly above the ink melting temperature, but significantly below the ink jetting temperature.

Co-pending U.S. patent application Ser. No. 07/965,812, filed Oct. 23, 1992, for a METHOD AND APPARATUS FOR PROVIDING PHASE CHANGE INK TO AN INK JET PRINTER, which is assigned to the assignee of this application, describes an ink-jet print head assembly having a premelt chamber, ink reservoir, and thermally isolated ink-jet print head. A printer using the ink-jet head assembly has start-up, idle, ready, and shutdown modes with each mode defining predetermined temperatures for the reservoir and print head. For example, in idle mode, the print head is kept at the same temperature as that of the reservoir, but when required to print, the print head temperature is rapidly elevated to bring the ink therein to its jetting temperature. The print head and its heater, temperature sensor, and temperature controller have a rapid thermal response time that reduces the time required to enter the ready mode and that acts to preserve the ink.

Phase-change ink-jet printers with reciprocating print heads produce high-quality images, but require a relatively long time to print each image. Print time can be shortened by increasing the number of jets printing the image. An ideal print head would span the full width of the image-receiving medium with ink-jet orifices spaced one picture element (hereafter "pixel") apart and would require only one scan of the print head relative to the print medium to print an image. It has been difficult, however, to produce such a print head. The nonuniform thermal loading on a media print head causes ink viscosity variation that adversely affects print quality. What is needed, therefore, is a substantially media-width, multiple-orifice, ink-jet print head having a heating system that heats the print head, and the phase-change ink contained therein, to a uniform temperature throughout the print head.

SUMMARY OF THE INVENTION

An object of the present invention is, therefore, to provide an apparatus and a method for heating a media-width phase-change ink-jet print head, and the phase-change ink contained therein, to substantially the same temperature throughout the print head.

Another object of this invention is to provide an apparatus and a method for rapidly regulating the temperature of a multiple-orifice phase-change ink-jet print head.

According to one aspect of the present invention, a print head having ink jets positioned in a jet section on a front major surface has a print head heater positioned against its rear major surface. The print head heater extends substantially across the jet section and preferably across the entire length of the print head and includes first and second overlapping heating zones. A transverse medial axis parallel to the major surfaces divides the print head into first and second sides. Each heating zone produces heat nonuniformly across its length to produce a heat gradient across the length of the print head. The amount of heat produced by the first heating zone decreases in the direction from the medial axis to the second print head side, and the amount of heat produced by the second heating zone decreases in the direction from the medial axis to the first print head side.

First and second temperature sensors sense the print head temperature at positions on the respective first and second sides of the print head axis. A temperature controller controls the amount of heat produced by the first and second heating zones in accordance with the temperatures sensed by the respective first and second temperature sensors.

One embodiment of this invention uses a flexible composite laminate heater in a multicolor, media-width phase-change ink-jet head. The print head has four rows of ink-jet orifices spread across its face with the ink in each orifice in each row requiring substantially the same temperature to ensure a uniform jetting velocity from every orifice. The print head is of a laminated stainless steel plate construction that is susceptible to thermal nonuniformities. Radiation, conduction, and convection losses are thermal transfer mechanisms that contribute to temperature gradients and nonuniform temperatures throughout the print head.

In a preferred embodiment, each heater zone comprises a conductor that produces heat nonuniformly along the length of the print head, with the first heating zone producing more heat at a first end of the print head and the second heater zone producing more heat at an opposing, second end of the print head. The heater controller uses a temperature sensor positioned toward the first end of the print head to control the first heating zone and uses a temperature sensor positioned toward the second end of the print head to control the second heating zone. A nonuniform amount of heat is thereby supplied across the print head length to compensate for the nonuniform cooling of the print head by its environment. In some embodiments, the amount of heat produced can vary linearly or non-linearly along the length of the print head, thereby compensating for the linear variation in thermal load caused by print head to image-receiving media spacing at the ends of the print head.

Because the edges of the print head are exposed to the air, which is at a lower temperature than that of the print head, there is a temperature gradient in the print head at its edges. In another aspect of the invention, the jet section of the print head is thermally isolated from the edges of the print head by a thermal break. In a preferred embodiment, the thermal break comprises an air pocket of an appropriate size to function as a thermal insulator.

Because of the need to maintain the ink in the reservoir at a lower temperature than the ink in the print head, the ink reservoir is kept thermally isolated from the print head, typically by an air gap. Air flowing through the air gap changes the thermal load on the print head, thereby changing its temperature. Another aspect of this invention is the use of a baffle or baffles to reduce the air flow between the reservoir and the print head. In a preferred embodiment, the baffle can comprise tabs integral with the print head heater that fold into the air gap between the reservoir and the print head.

Additional objects and advantages of the present invention will be apparent from the following detailed description of preferred embodiments thereof, which proceeds with reference to the accompanying drawings.

DETAILED DESCRIPTION OF PREFERRED EMBODIMENTS

Figure 1:
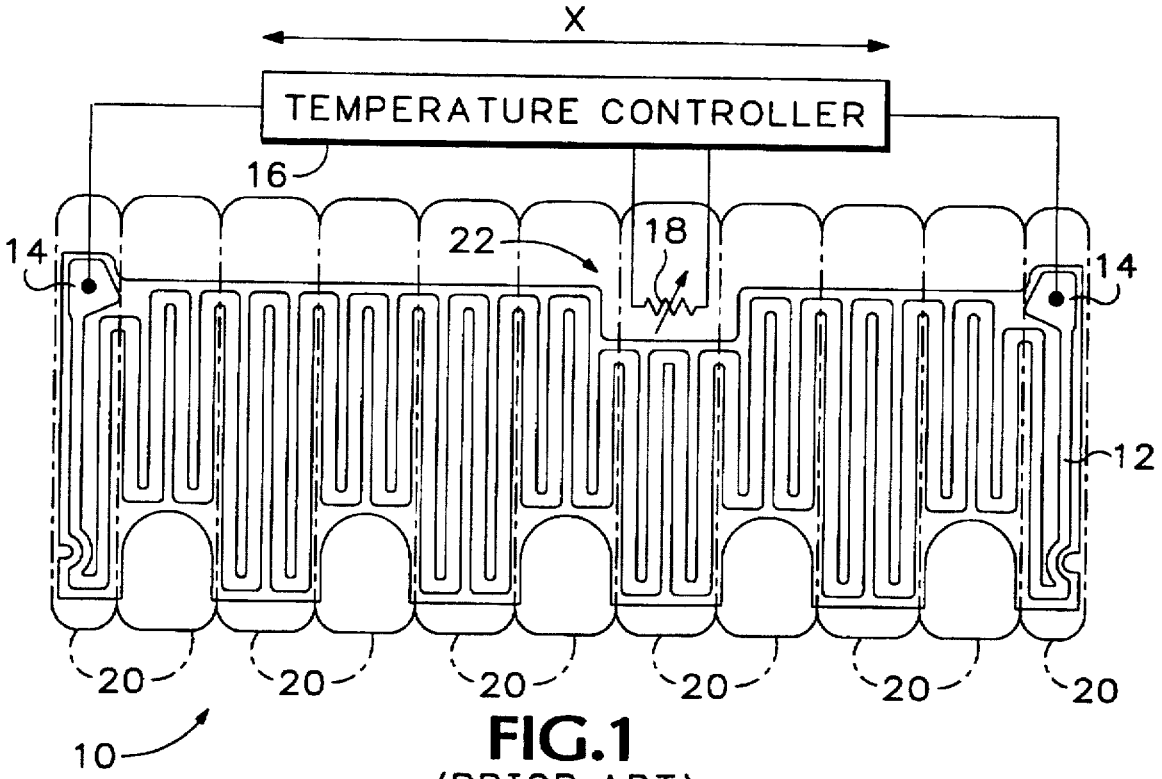
FIG.1 (PRIOR ART)
FIG. 1 is a pictorial plan view of a prior art ink-jet print head heater element having heating zones spaced across the length of the print head and showing schematically the electrical interconnection of the heater element with a temperature controller and a temperature sensor.
Figure 2:
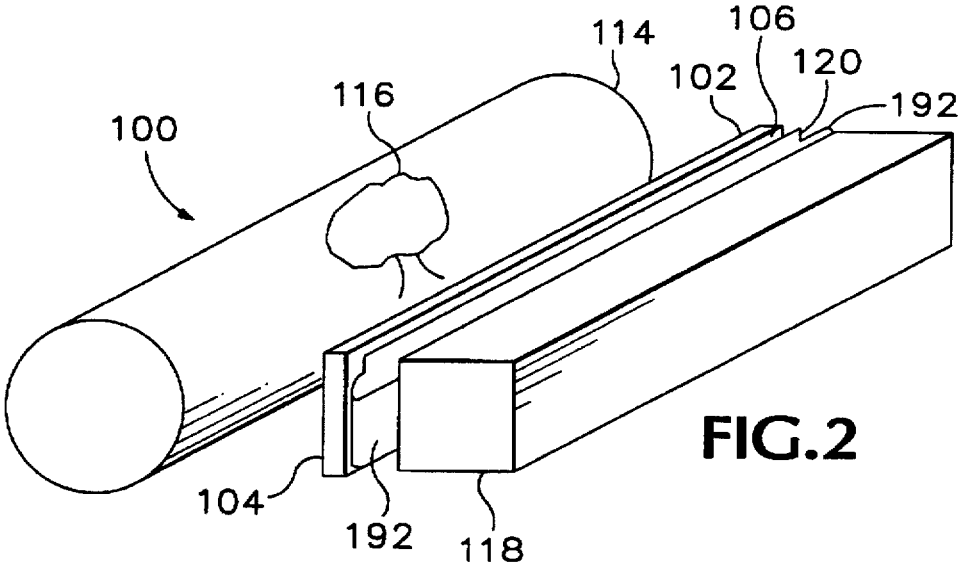
FIG. 2 is an exploded isometric view of a preferred embodiment of an ink-jet print head assembly of the present invention.

FIG. 2 shows a media-width, multicolor ink-jet print head assembly 100 including a print head 102 having front and rear major surfaces 104 and 106. Ink jets (not shown) eject ink from front major surface 104 onto an image-receiving surface, such as a drum 114, to form an image 116. A reservoir 118 is spaced apart from and supplies ink to print head 102. An ink-jet print head heater 120 attached to and substantially covering rear major surface 106 maintains the ink throughout print head 102 at a substantially uniform temperature.

Figure 3:
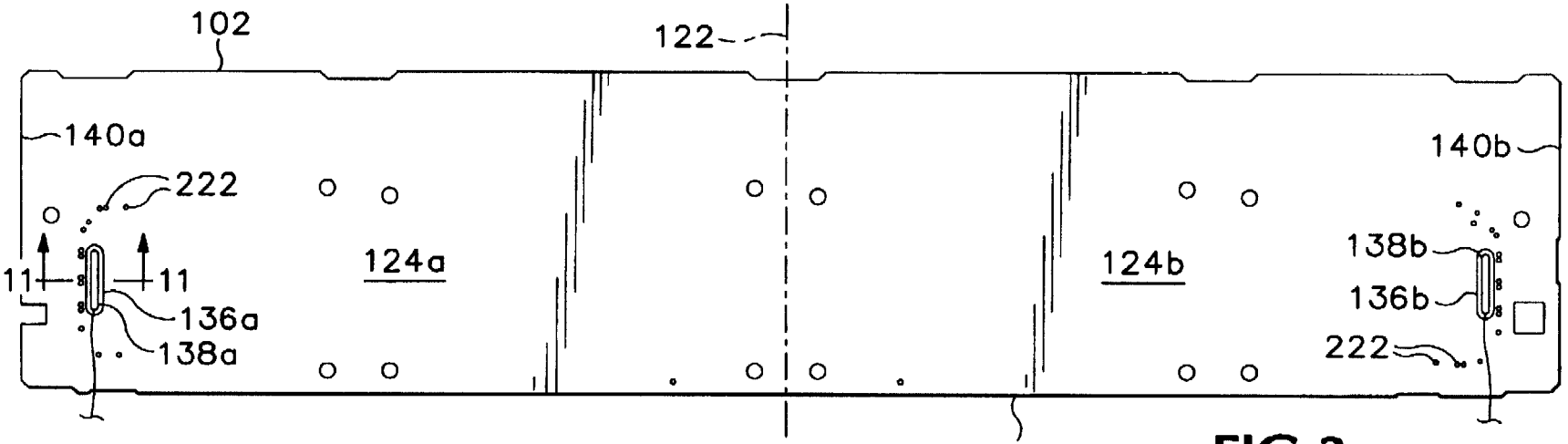
FIG. 3 is a rear elevation view of the ink-jet print head of FIG. 2.

FIG. 3 is a rear elevation view of print head 102, shown without heater 120. A transverse medial axis 122 parallel to major surfaces 106 and 104 of FIG. 2 divides the print head into first and second sides **124*a* and 124*b*, preferably of equal size. Print head 102 includes cavities 136*a* and 136*b* for receiving respective thermistors 138*a* and 138*b* that sense print head temperatures on first and second sides 124*a* and 124*b*, preferably toward respective first and second side margins 140*a* and 140*b* of rear major surface 106**.

Figure 4:
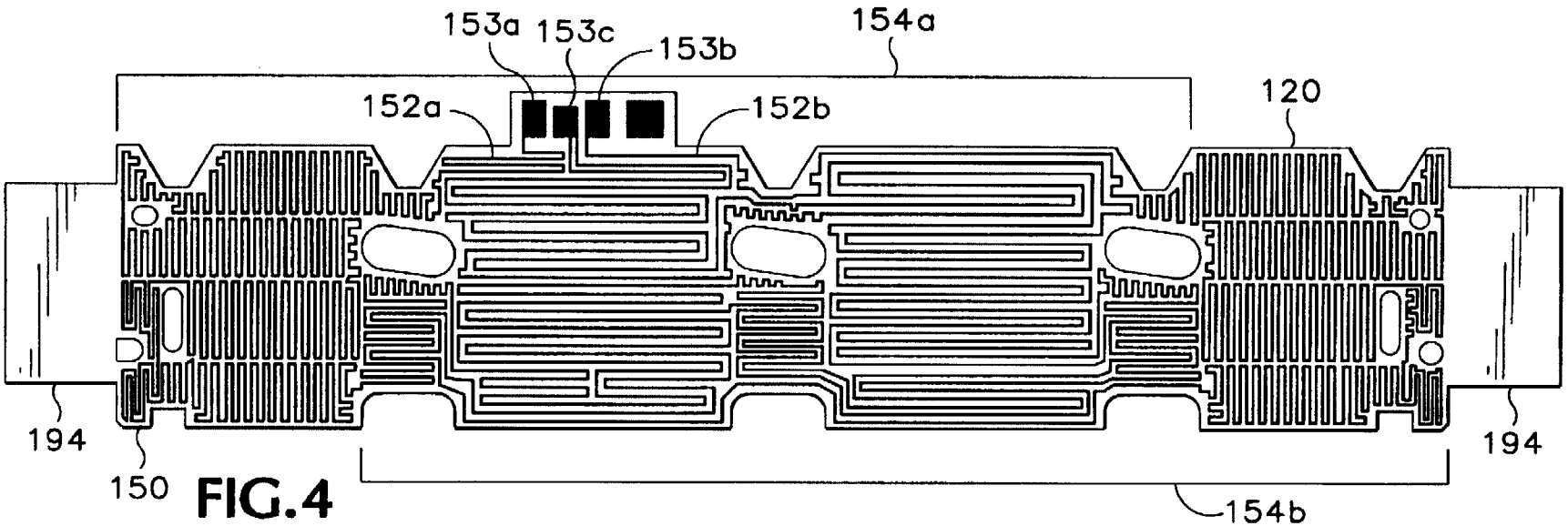
FIG. 4 is a front elevation view of the print head heater of FIG. 2.

FIG. 4 shows a preferred print head heater 120 comprising a flexible composite laminate 150. Two conductors **152*a* and 152*b* formed on the flexible composite laminate 150 define two overlapping heating zones 154*a* and 154*b*. In a preferred embodiment, conductors 152*a* and 152*b* form a nonintersecting, interdigitated pattern on a single level of the flexible composite laminate 150. Conductors 152*a* and 152*b* could also be formed on separate levels of flexible composite laminate 150** and would not need to be interdigitated to avoid intersecting.

Conductive sections along the length of conductors **152*a* and 152*b* produce heat in proportion to the electrical current in and the resistivity of the section. The amount of heat produced in a particular area of heater 120** depends upon the number of conductors in the area and the resistivity of the conductors in the area.

The current flowing in all sections within one of conductors **152*a* or 152*b* is the same, but different conductor sections can be fabricated to have different resistivities, thereby controlling the relative amount of heat produced by the different sections. The resistivity of a conductive section is proportional to its cross-sectional area. The thickness of the conductor may be uniform, so the conductor is formed of varying widths in different sections to produce different cross-sectional areas, thereby producing sections having different resistivities that produce different amounts of heat. However, it is preferred that the thickness of the conductor be varied, either uniformly tapered or irregularly varied running either transversely or parallel to the transverse medial axis 122** to increase heat output or achieve the desired amount of heat.

In a preferred embodiment, the pattern of conductor **152*a* is fabricated so that when heater 120 is attached to print head 102 the heat produced in heating zones 154*a* increases to a maximum toward side margin 140*a* of print head 102 and decreases to a minimum, typically zero, toward side margin 140*b*. Similarly, the pattern of conductor 152*b* is fabricated so that the heat produced in heating zones 154*b* increases to a maximum toward side margin 140*b* and decreases to a minimum, typically zero, toward side margin 140*a***.

A temperature controller (not shown) controls the temperature of print head 102 by applying to heater 120 a pulse-duration-modulated voltage across conductors **152*a* and 152*b* through respective contacts 153*a* and 153*b* and a common contact 153*c*. The temperature controller applies voltage across conductor 152*a* in response to temperature sensed by thermistor 138*a* and applies voltage across conductor 152*b* in response to temperature sensed by thermistor 138*b*. Alternatively, the temperature controller could respond to a weighted average of the temperatures sensed by thermistors 138*a* and 138*b*, with the voltage applied to conductor 152*a* being determined predominately by the temperature sensed by thermistor 138*a* and the voltage applied to conductor 152*b* being determined predominantly by the temperature sensed by thermistor 138*b***.

Figure 5:
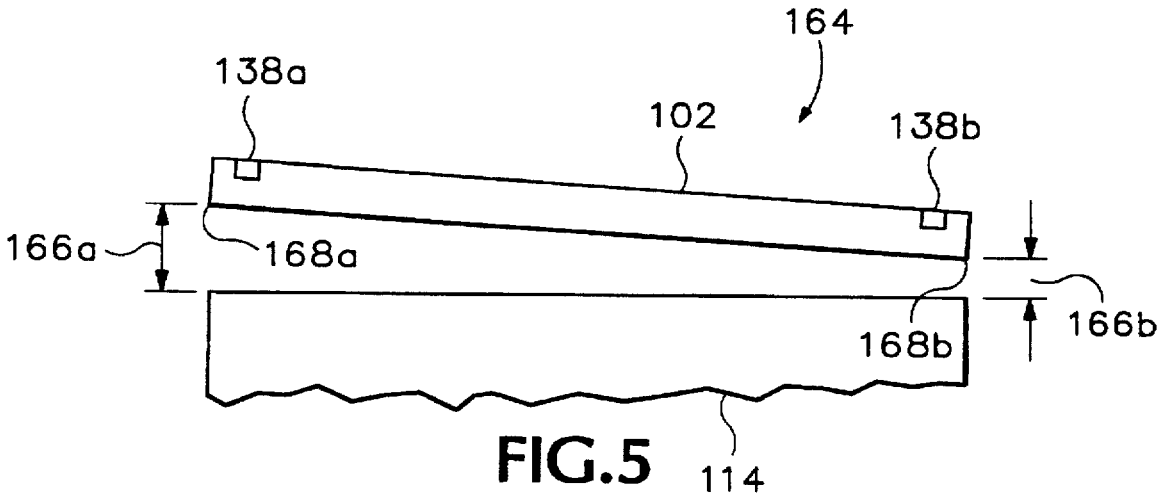
FIG. 5 is a fragmentary, top view of the ink-jet print head assembly of FIG. 2 showing the variation in head-to-drum distance across the print head.

The temperatures sensed by thermistors **138*a* and 138*b* vary with the thermal loads on print head 102. The thermal load changes with events, such as fans turning on and off and access doors opening or closing. The thermal loads also depend upon the structure of the printer. For example, a printer 164 is characterized by a head-to-drum spacing 166 (FIG. 5), which is the distance between print head 102 and drum 114 at any point along the length of print head 102. FIG. 5 shows that the head-to-drum spacing 166 is not always uniform along the entire length of print head 102. Spacing 166*a* at a first print head edge 168*a* is greater than spacing 166*b* at the opposing print head edge 168*b*, thereby producing a greater thermal load at print head edge 168*b***.

Figure 6:
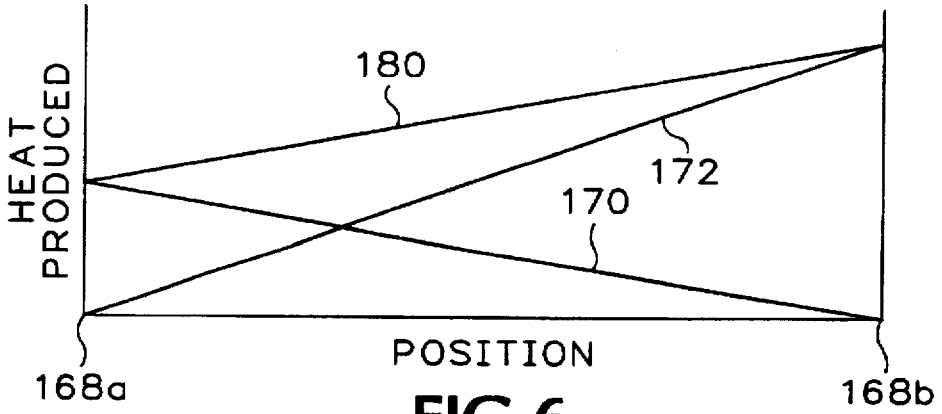
FIG. 6 is a plot showing qualitatively the idealized heat output from the two heating zones of the print head heater of FIG. 4.

FIG. 6 shows an idealized plot of heat produced by conductors **152*a* and 152*b* as a function of position along ink jet print head 102. The heat produced by conductor 152*a* is shown by line 170 to be a maximum at edge 168*a* and zero at edge 168*b*. The heat produced by conductor 152*b* is shown by line 172 to be a maximum at edge 168*b* and zero at edge 168*a*. The total heat produced by conductors 152*a* and 152*b* is shown by line 180 to increase linearly from edge 168*a* to edge 168*b***.

Figure 7:
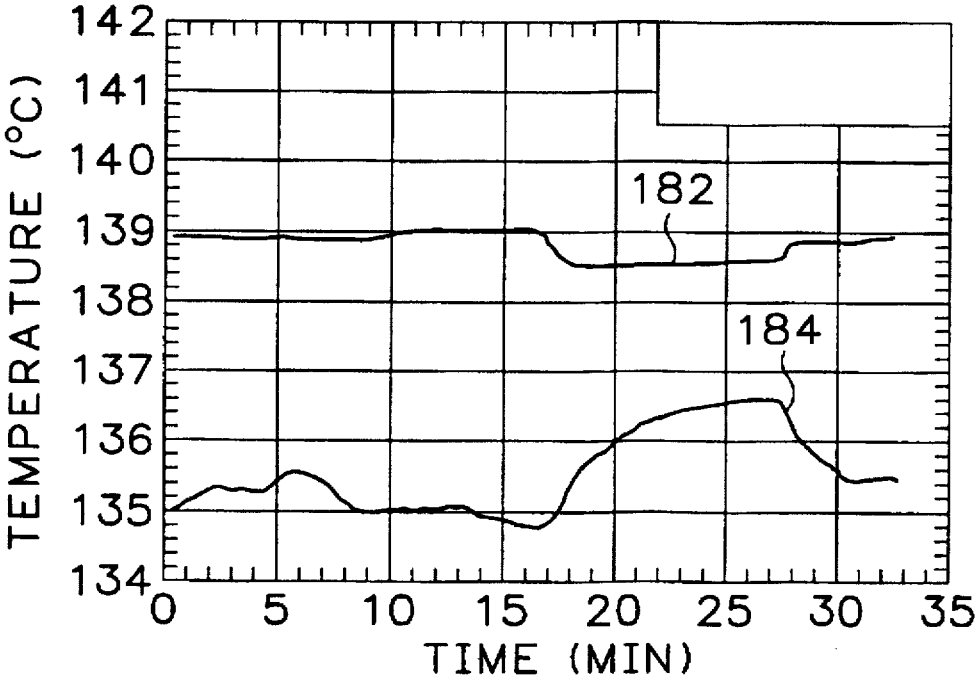
FIG.7 (PRIOR ART)
FIG. 7 is a graph showing temperature plotted against time at the two ends of a print head using a prior art, single zone heater.

FIG. 7 shows the thermal behavior of a print head 102 that is mounted as shown in FIG. 5 at an angle to drum 114 and is heated by a prior art, single zone heater. Curves 182 and 184 plot the temperatures measured during a thirty-five minute time interval by thermistors **138*a* and 138*b*** (FIG. 5).

During the measurements, the head-to-drum spacing 166b was twelve percent smaller than the head-to-drum spacing 166a and the temperature controller controlled the heater by using the temperature sensed by the single thermistor 138a.

Curves 182 and 184 show that the print head is approximately 4° C. cooler, as measured by thermistors 138a and 138b, near side margin 140b than near side margin 140a. Side margin 140b is cooler because the controller, which is controlling the single zone heater using temperatures sensed at the opposite end of the print head to side margin 140b, does not compensate for the increased thermal load near side margin 140b caused by the closer drum.

FIG. 7 also shows the affect of environmental changes on the print head temperature. At approximately fifteen minutes into the time interval, a fan was turned on, causing a change in the temperatures measured near both side margins 140a and 140b. The temperature at side margin 140b, at the opposite end of print head 102 from thermistor 138a, changed by approximately 1.5° C., whereas the temperature near side margin 140b changed by less than 0.5° C. The differences in head temperature from end 140a to 140b and the changes over time cause variations in the ink density, which changes the ink drop mass and adversely affects print quality.

Figure 8:
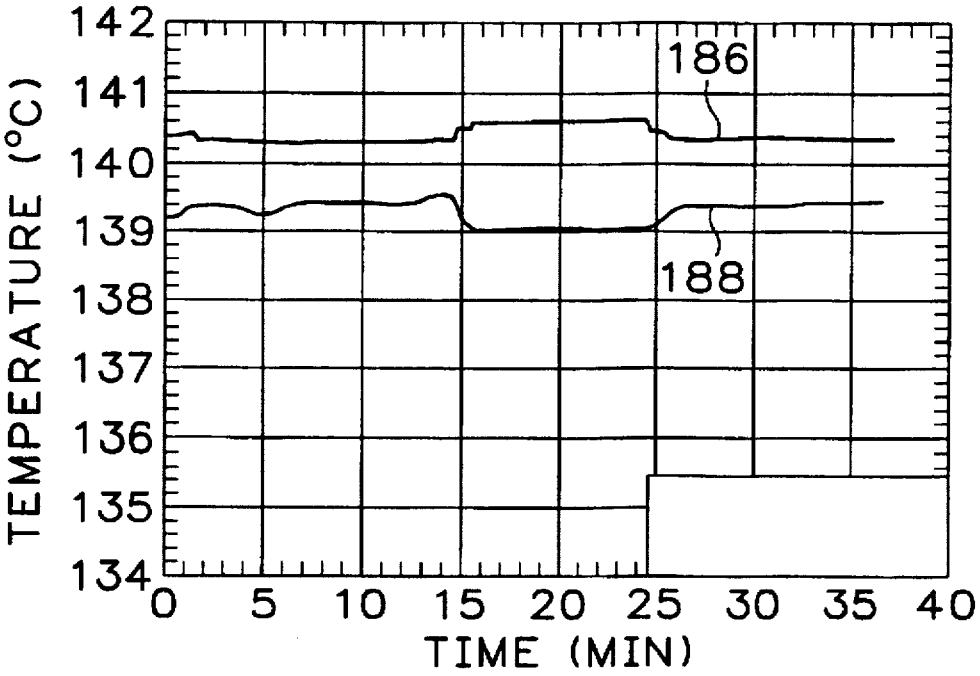
FIG. 8 is a graph showing temperature plotted against time at the two ends of a print head using the dual zone heater of FIG. 3.

FIG. 8 shows temperatures measured during a thirty-five minute time interval by thermistors 138a and 138b attached to a print head 102 using a two-zone heater of the present invention. The temperature measurement were performed under conditions similar to those of FIG. 7, that is, the head-to-drum spacing 166b was twelve percent smaller than the head-to-drum spacing 166a, and a fan was turned on about fifteen minutes into the measurement interval. Curve 186 shows the temperature near side margin 140a as measured by thermistor 138a and curve 188 shows the temperature measured near side margin 140b as measured by thermistor 138b.

Curves 186 and 188 together show that the temperature differences between rear major surface 106 regions near side margin 140a and near 140b are less than about 1.5° C. Curves 186 and 188 also show that the temperature variation over time near both side margins 140a and 140b is less than about 0.5° C.

Table 1 below shows the effect of changes in head-to-drum spacing on ink drop mass for a print head 102 using a prior art, single-zone heater and for a print head 102 using a and two-zone heater 120 of the present invention. The drop masses were calculated from the temperatures obtained during a procedure similar to that which produced the results shown in FIGS. 7 and 8.

TABLE 1

Drop Mass Sensitivity to Changes In Head-to-Drum Spacing

| (units: ngm/mil nanograms of ink per 0.025 mm (0.001 in) spacing) | Print Head Near Side Margin a | Print Head Near Side Margin b |
|---|---|---|
| Prior Art - Single-zone heater | 0.2 | 1.6 |
| Two-zone heater of the invention | 0.2 | 0.2 |

As shown in Table 1, the drop mass from jets near the side margins 140a and 140b of a print head 102 using heater 120 of the present invention will be approximately equal, whereas the drop masses from jets adjacent margin b of a print head using a single zone prior art heater will be eight times more sensitive to changes in head-to-drum spacing.

Figure 9:
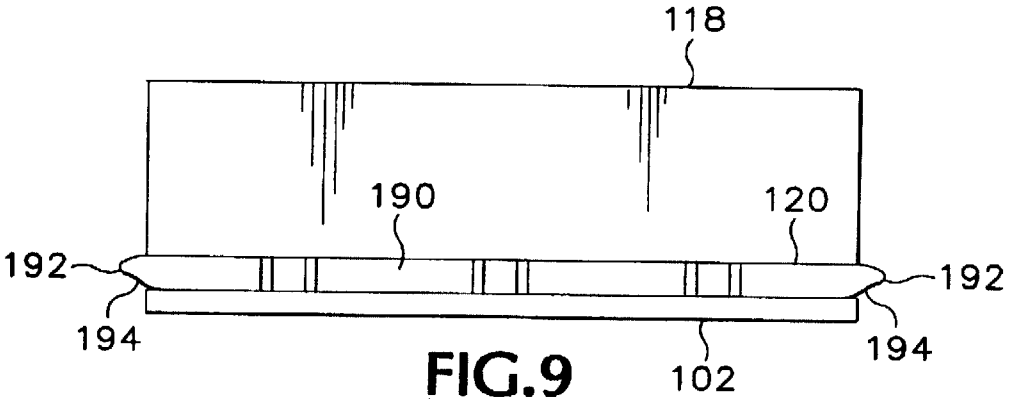
FIG. 9 is a top view of the print head assembly of FIG. 2, showing baffles that reduce airflow between the print head and the ink reservoir.

Another source of thermal variation across print head 102 is air flowing between print head 102 and reservoir 118. The rotation of drum 114 produces much of the airflow around head 102 when the printer is printing. FIG. 9 shows that reservoir 118 is separated from print head 102 by a gap 190. Gap 190 is used to thermally isolate reservoir 118 because the ink in reservoir 118 is maintained at a lower temperature than that of the ink in head 102 to prevent ink degradation. In another aspect of the present invention, a baffle 192 is provided to reduce air flow between print head 102 and reservoir 118.

Baffle 192 is preferably formed from flexible composite laminate 150 (FIG. 4) as tabs 194 that extend past ends 140a and 140b of head 102. During the manufacture of print head 102, tabs 194 are folded back into gap 190 between reservoir 118 and print heat 102 to form baffles 192. Tabs 194 can, but need not, be secured using an adhesive or a mechanical fastener. Although baffles 192 are shown at edges 168a and 168b of print head 102, baffles could also be placed at other edges of head 102.

Tables 2 and 3 show the results of an experiment in which the temperature of the print head was measured and the drop mass calculated for print heads with and without baffles 192. Where baffles were installed, the data obtained is for baffles installed in the top of the jet stack between the reservoir and the jet stack. Both tables represent five consecutive print operations, with the print head temperature monitored and the drop mass calculated for each print operation.

TABLE 2

Drop Mass Without Baffles

| Print Operation | Relative Drop Mass (ngm) | Temperature (°C.) |
|---|---|---|
| 1 | 0 | 144.7 |
| 3 | −2.6 | 142.5 |
| 5 | −3.8 | 141.7 |
| Range | −3.8 | 3.7 |

TABLE 3

Drop Mass With Baffles

| Print Operation | Relative Drop Mass (ngm) | Temperature (°C.) |
|---|---|---|
| 1 | 0 | 145.0 |
| 3 | −0.1 | 144.6 |
| 5 | −1.1 | 144.4 |
| Range | −1.1 | 0.6 |

Tables 2 and 3 show that during the five print operations, the temperature varied only 0.6° C. in the print head 102 having baffles 192, whereas the temperature varied 3° C. in the print head without baffles 192. The resultant drop masses varied 3.8 ngm in the print head without baffles, but only varied 1.1 ngm in the print head with baffles 192. The more consistent drop mass produces improved print quality.

Another source of thermal nonuniformity in head 102 is thermal gradients near its edges caused by the temperature difference between the print head 102 and the surrounding air. According to another aspect of the invention, the ink jets are thermally insulated from the edges of print head 102 by pockets of trapped air.

Figure 10:
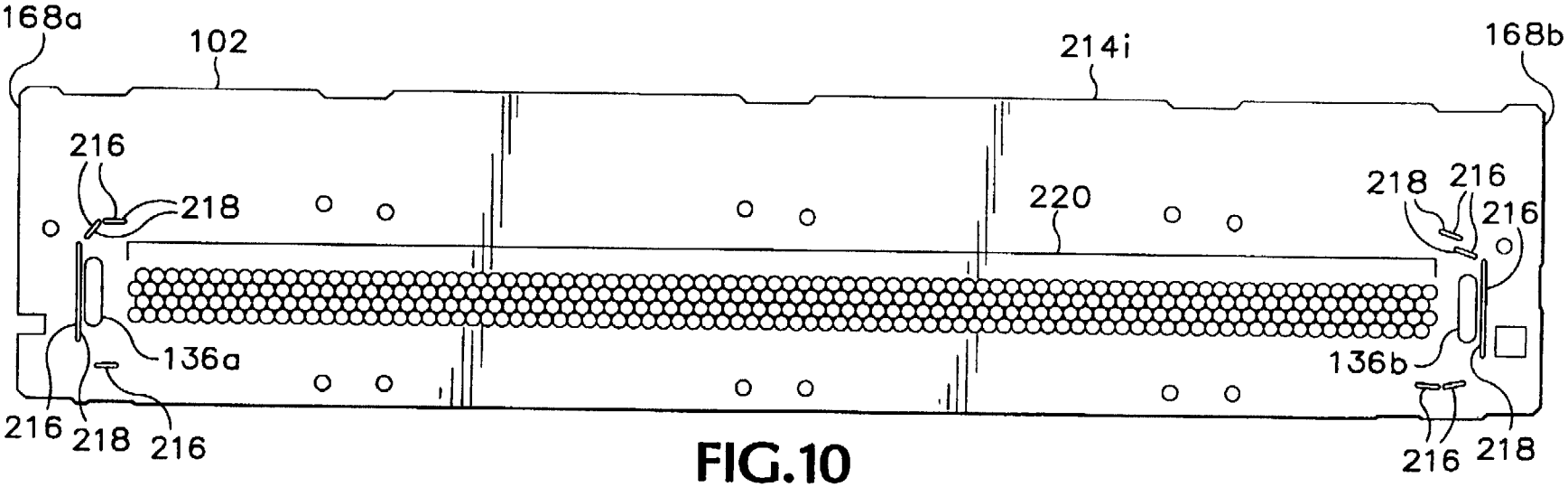
FIG. 10 is a front elevation view of one of the internal layers of the print head of FIG. 2.
Figure 11:
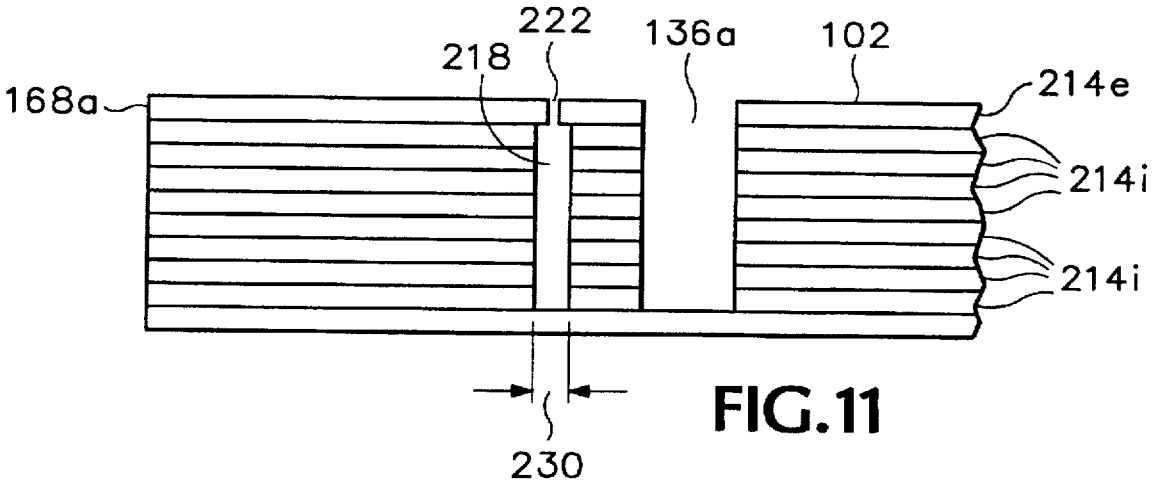
FIG. 11 is an enlarged cross-sectional view taken along lines 11—11 of FIG. 3 and showing a thermal break of the present invention.

FIG. 10 shows an exemplary internal layer 214i of print head 102. Layer 214i includes multiple, narrow voids 216 that form parts of multiple thermal breaks 218 to insulate a jet section 220, in which the ink jets are formed, from edges 168*a* and 168*b*. FIG. 11 is an enlarged cross-sectional view of a portion of print head 102 and shows a preferred thermal break 218 comprising an air pocket formed by matching voids of the internal layers 214*i*.

Thermal breaks 218 restrict the temperature gradients to noncritical edge areas and maintain a more uniform temperature within jet section 220. Small holes 222 (FIGS. 3 and 11) are typically provided in an external layer 214*e* to prevent pressure changes in thermal break 218 as temperature changes in print head 102 cause the trapped air to expand or contract.

Thermal break 218 has a width 230 that is sufficiently narrow to have minimal impact on the size and strength of print head 102, but is sufficiently wide to insulate jet section 220 from edges 168*a* and 168*b*. A preferred range for width 230 is between about 0.008 inches or 0.203 mm and about 0.040 inches or 1.016 mm, with a width 230 of approximately 0.011 inches or 0.016 mm, with a width 230 of and about 0.040 inches or 1.016 mm, with a width 230 of approximately 0.011 inches or 0.279 mm having been found to be satisfactory in one embodiment. Multiple thermal break 218 can be formed in different areas of the print head to isolate temperature sensitive areas and can be formed of any thermally insulating material. To obtain accurate temperature readings, thermistors 138*a* and 138*b* are positioned so that they too are insulated from thermal gradients at edges 168*a* and 168*b*.

Figure 12:
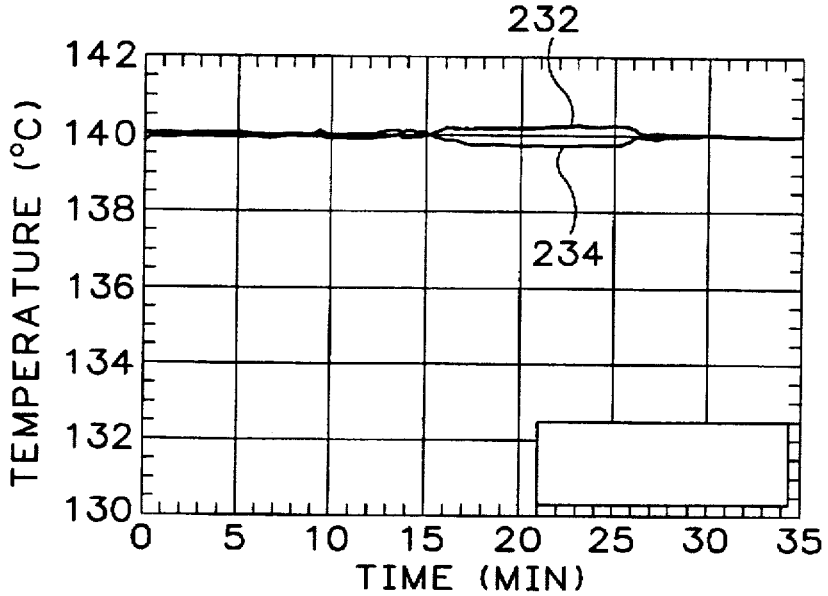
FIG. 12 is a graph showing temperature plotted against time at the two ends of a print head using the two-zone heater of FIG. 4, the baffles of FIG. 9, and the thermal breaks of FIG. 3.

FIG. 12 shows temperatures measured during a thirty-five minute time interval by thermistors 138*a* and 138*b* attached to print head 102 using two-zone heater 120, baffles 192, and thermal breaks 218 of the present invention. As in the temperature measurement of FIGS. 7 and 8, the head-to-drum spacing 166*b* was twelve percent smaller than the head-to-drum spacing 166*a* and a fan was turned on about fifteen minutes into the measurement interval.

Curves 232 and 234 of FIG. 12 represent the temperatures near respective side margins 140*a* and 140*b* during the thirty-five minute interval. Curves 232 and 234 show that the temperature near each side margins 140*a* and 140*b* varies less than 0.2° C. within the time period approximately 0.5° C. The temperature stability and uniformity of a print head of the present invention produce uniform drop mass and consistently superior print quality.

It will be obvious that many changes may be made to the above-described details of the invention without departing from the underlying principles thereof. For example, although a two-zone heater is described, a multiple-zone heater having more than two zones could be constructed in accordance with the principles of the present invention. The scope of the present invention should, therefore, be determined only by the following claims.

What is claimed is:

1. An apparatus for maintaining a predetermined ink temperature profile throughout a multiple-orifice phase-change ink-jet print head, the print head having a jet section in which ink jets are positioned, a front major surface from which ink is ejected, and a rear major surface opposed to the front major surface, the print head having a transverse medial axis parallel to the major surfaces and dividing the print head into first and second sides, the apparatus comprising:

a print head heater positioned against the rear major surface and extending across the length of the jet section, the print head heater including a first heating zone for producing a heat gradient decreasing in a first direction along the rear major surface transverse to and toward a second heating zone from the medial axis the second heating zone producing a heat gradient decreasing in a second direction, opposite to the first, along the rear major surface, the first and second heating zones including overlapping portions;

first and second temperature sensors sensing the print head temperature at positions on the respective first and second sides of the print head axis; and a temperature controller controlling the first and second heating zones in accordance with the temperatures sensed by the first and second temperature sensors to maintain a predetermined temperature profile throughout a multiple-orifice, phase-change ink-jet print head.

2. The apparatus of claim 1 in which the first and second temperature sensors are used to control the temperature in the respective first and second heating zones.

3. The apparatus of claim 1 in which the respective heat gradients decrease to zero in the first and second directions.

4. The apparatus of claim 1 in which the print head heater comprises a flexible composite laminate material and the first and second heating zones are located on a single level.

5. The apparatus of claim 4 in which the heating zones are formed in a nonintersecting, interdigitated pattern.

6. The apparatus of claim 1 in which the print head includes at least one thermal break to thermally insulate the jet section.

7. The apparatus of claim 1 further comprising:

an ink reservoir for supplying ink to the print head, the ink reservoir being spaced apart from and operatively connected to the print head; and a thermal baffle positioned in relation to the ink reservoir and print head to reduce air flow between ink reservoir and print head.

8. The apparatus of claim 7 in which the print head includes a thermal break to thermally insulate the jet section.

9. A method for maintaining a predetermined ink temperature profile throughout a multiple-orifice, phase-change ink-jet print head having a rear major surface opposed to a front major surface from which ink is ejected, the print head having a transverse medial axis parallel to the major surfaces and dividing the print head into first and second sides, the method comprising the steps of:

sensing a first temperature at the first side of the print head;

applying to the rear surface of the print head through a first print head heating zone a first heat gradient in which more heat is applied to the first side of the print head than to the second side of the print head, the amount of heat applied being related to the first temperature;

sensing a second temperature at the second side of the print head; and applying heat to the rear surface of the print head through a second print head heating zone a second heat gradient in which more heat is applied to the second side of the print head than to the first side of the print head, the amount of heat applied being related to the second temperature, whereby the two heat gradients result in a predetermined ink temperature profile throughout a multiple-orifice, phase-change ink-jet print head.

10. The method of claim 9 in which the first temperature is sensed near a first side margin of the rear major surface, the second temperature is sensed near a second side margin of the rear major surface, applying heat through the first print head heating zone includes applying a heat gradient that varies from a maximum at the first side margin to a minimum at the second side margin, and applying heat through the second print head heating zone includes applying a heat gradient that varies from a maximum at the second side margin to a minimum at the first side margin.

11. A phase-change ink-jet print head having a section including multiple orifices positioned between first and second opposing edges, the improvement comprising:

a thermal break providing insulation between the section including the multiple orifices and the edges to maintain a more uniform temperature within the section including the multiple orifices.

12. The first head of claim 11 in which the thermal break includes an air gap.

13. The print head of claim 12 in which the air gap includes an air pocket having ventilation holes.

14. A multiple-orifice, phase-change ink-jet print head receiving ink from an ink reservoir separated from the reservoir by an air gap, the improvement comprising:

an air flow obstructor positioned at an edge of the print head and reducing the flow of air between the reservoir and the print head to reduce nonuniform cooling of the print head and thereby improve temperature uniformity of the print head.

15. The print head of claim 14 in which the air flow obstructor is attached to the print head heater.

16. The print head of claim 14 in which the air flow obstructor comprises a portion of a flexible composite laminate material that comprises the print head heater.

17. An apparatus for maintaining a predetermined ink temperature profile throughout a multiple-orifice, phase-change ink-jet print head, the print head having a jet section in which the ink jets are positioned and a rear major surface opposed to a front major surface from which ink is ejected, the rear major surface having first and second opposing edges, the apparatus comprising:

a print head heater attached to the rear surface and including multiple heating zones that produce nonuniform heat output within a zone;

a thermal break within the print head to thermally insulate the jet section;

multiple temperature sensors sensing the print head temperature at multiple sensor positions, each of the multiple sensor positions corresponding to one or more of the heater zones; and a temperature controller controlling the multiple heater zones in accordance with the temperature sensed by the corresponding temperature sensors to maintain a predetermined temperature profile throughout a multiple-orifice, phase-change ink-jet print head.

18. The apparatus according to claim 17 in which the print head heater has resistive conductors of varying thickness taken either transversely or parallel to a transverse medial axis of the print head.

19. An apparatus for maintaining a predetermined ink temperature profile throughout a multiple-orifice phase-change ink-jet print head, the print head having a jet section in which the ink jets are positioned and a rear major surface opposed to a front major surface from which ink is ejected, the rear major surface having first and second side margins, the apparatus comprising:

a print head heater attached to the rear major surface and having first and second ends corresponding to the first and second side margins of the print head, the print head heater including a first heating zone producing more heat at the first end than at the second end and a second heating zone producing more heat at the second end than at the first end;

a thermal break within the print head to thermally insulate the jet section;

first and second temperature sensors sensing the print head temperature near the respective first and second side margins of the print head; and a temperature controller controlling the first and second heater zones in accordance with the temperatures sensed by the respective first and second temperature sensors to maintain a predetermined temperature profile throughout a multiple-orifice, phase-change ink-jet print head.

20. The apparatus of claim 18 further comprising:

an ink reservoir for supplying ink to the print head, the ink reservoir being spaced apart from and operatively connected to the print head; and a thermal baffle positioned in relation to the ink reservoir and print head to reduce air flow between ink reservoir and print head.

* * * * *

UNITED STATES PATENT AND TRADEMARK OFFICE

CERTIFICATE OF CORRECTION

PATENT NO. : 5,635,964

DATED : June 3, 1997

INVENTOR(S) : Ronald F. Burr, et al

It is certified that error appears in the above-indentified patent and that said Letters Patent is hereby corrected as shown below:

Column 11, line 14, change "first" to --print--.

Signed and Sealed this

Ninth Day of September, 1997

*Attest:*

Bruce Lehman

BRUCE LEHMAN

*Attesting Officer*

*Commissioner of Patents and Trademarks*